United States Patent [19]

Crane et al.

[11] 4,175,912

[45] Nov. 27, 1979

[54] AXIAL FLOW GAS TURBINE ENGINE COMPRESSOR

[75] Inventors: John L. Crane; Robert W. Archdale, both of Bristol; Alan E. Webb, Berkeley, all of England

[73] Assignee: Rolls-Royce Limited, London, England

[21] Appl. No.: 839,292

[22] Filed: Oct. 4, 1977

[30] Foreign Application Priority Data

Oct. 19, 1976 [GB] United Kingdom ..... 43250/76

[51] Int. Cl.[2] ..... F01D 5/22

[52] U.S. Cl. ..... 416/193 A; 416/244 A; 416/230; 416/134 R; 416/500

[58] Field of Search ..... 416/193 A, 500, 134, 416/134 A, 230 R, 241 A, 244 A

[56] References Cited

U.S. PATENT DOCUMENTS

| | | | |
|---|---|---|---|
| 2,936,155 | 5/1960 | Howell et al. | 416/134 |
| 3,008,689 | 11/1961 | Morley et al. | 416/193 A |
| 3,294,364 | 12/1966 | Stanley | 416/193 A |
| 3,494,539 | 2/1970 | Littleford | 416/244 A |
| 3,616,508 | 11/1971 | Wallett | 416/230 X |
| 3,656,864 | 4/1972 | Wagle | 416/230 X |
| 3,675,294 | 7/1972 | Palfreyman et al. | 29/156.8 R |
| 3,758,232 | 9/1973 | Wallett | 416/213 |
| 3,813,185 | 5/1974 | Bouiller et al. | 416/193 A |
| 3,905,722 | 9/1975 | Guy et al. | 416/193 |

FOREIGN PATENT DOCUMENTS

| | | | |
|---|---|---|---|
| 1204858 | 8/1959 | France | 416/193 A |
| 1394739 | 5/1975 | United Kingdom | 416/244 A |
| 1457417 | 12/1976 | United Kingdom | 416/193 A |

*Primary Examiner*—Everette A. Powell, Jr.
*Attorney, Agent, or Firm*—Stevens, Davis, Miller & Mosher

[57] ABSTRACT

A rotor blade stage for the compressor of a gas turbine engine comprising a rotor disc having a plurality of equally spaced apart rotor blades mounted on its periphery. The spaces between the rotor blades in the region of the periphery of the rotor disc are infilled with a mixture comprising reinforcing filaments enclosed in a matrix of a cured epoxy resin and filler material. Means are provided to retain the mixture in position between the rotor blades upon rotation of the rotor disc.

6 Claims, 3 Drawing Figures

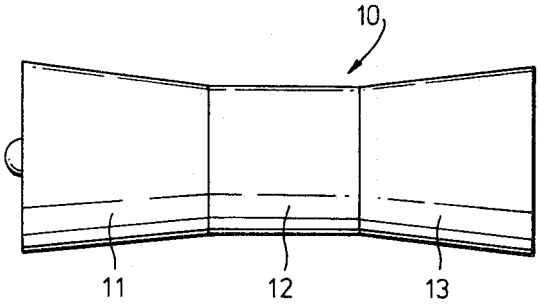
Fig. 1
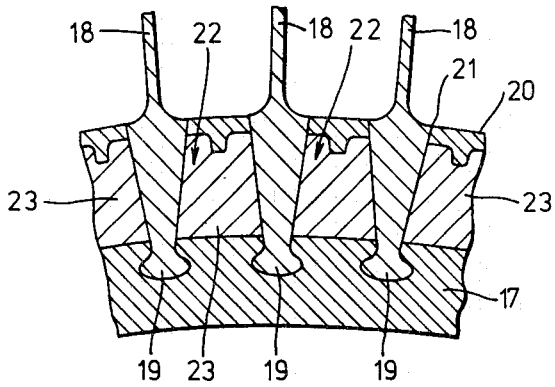
Fig. 3
Fig. 2
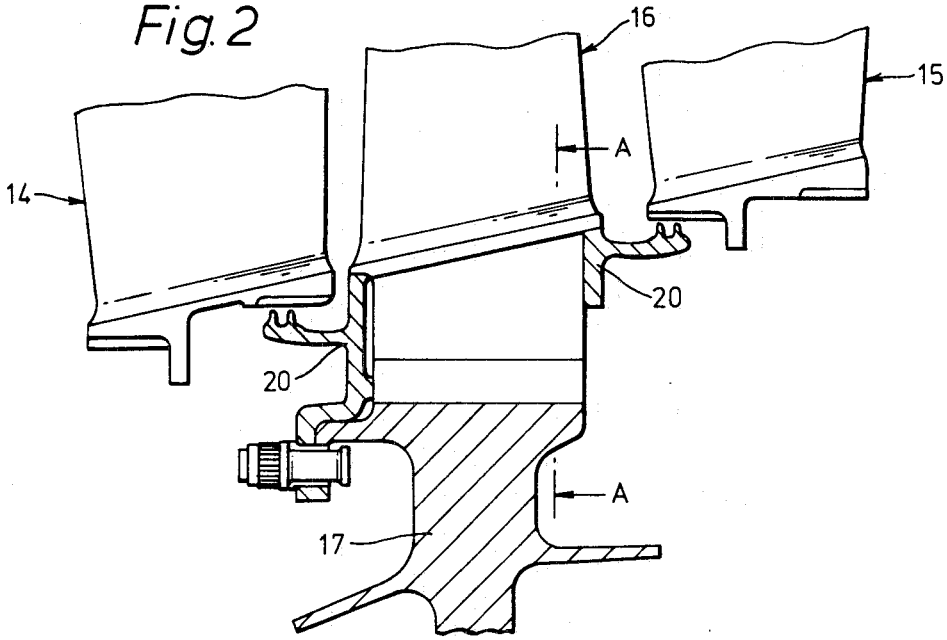

AXIAL FLOW GAS TURBINE ENGINE COMPRESSOR

This invention relates to an axial flow gas turbine engine compressor and in particular to the rotor stages of such a compressor.

The axial flow compressor of a gas turbine engine is provided with a number of rotor stages which are adapted to cooperate with corresponding stator stages to achieve air compression. It is commonly found during the operation of such compressors that the rotor blades tend to vibrate to a certain extent. Whilst such vibration is acceptable within certain limits, damage to the blades can occur if those limits are exceeded.

It is an object of the present invention to provide means for damping such vibrations.

According to the present invention, a rotor blade stage for the compressor of a gas turbine engine comprises a rotor disc having a plurality of equally spaced apart rotor blades mounted on its periphery, the spaces between said rotor blades in the region of the periphery of said rotor disc being infilled with a mixture which comprises reinforcing filaments enclosed in a matrix, which matrix in turn comprises a cured epoxy resin and a filler material, means being provided to retain said mixture in position between said rotor blades upon the rotation of said rotor disc.

Said filaments are preferably of carbon.

Said carbon filaments are preferably not longer than 0.25 mm.

Said filler material preferably comprises a thixotropic filler, titanium dioxide, calcined bauxite and atomized aluminium powder.

Said epoxy resin is preferably cured after said spaces between said rotor blades in the region of the periphery of said rotor disc have been infilled with said mixture.

Said epoxy resin may be cured by heating at 100° C. for sixteen hours followed by an increase in temperature to 200° C. at the rate of 25° C. per hour, maintaining the temperature at 200° C. for four hours, increasing the temperature at the rate of 25° C. per hour to 250° C. and maintaining the temperature of 250° C. for one hour.

Said means provided to retain said mixture in position between said rotor blades may comprise an annular member having slots adapted to receive said rotor blades and which is spaced apart from said rotor disc, so as to define cavities with said rotor disc periphery and said rotor blades within which said mixture is located.

The invention will now be described with reference to the accompanying drawings in which:

FIG. 1 is a side view of a gas turbine engine provided with a compressor having a rotor blade stage in accordance with the present invention, FIG. 2 is a side view of a portion of the compressor of the gas turbine engine shown in FIG. 1, and FIG. 3 is a view on line A—A of FIG. 2.

With reference to FIG. 1 a gas turbine engine generally indicated at 10 is of conventional construction with an axial flow compressor 11, combustion equipment 12 and an axial flow turbine 13. The compressor 11 includes a number of alternate rotor and stator stages, three of which can be seen in FIG. 2. More specifically FIG. 2 shows two stator stages 14 and 15 between which is interposed a rotor stage 16.

The rotor stage 16 comprises a rotor disc 17 having a plurality of equally spaced apart rotor blades 18 mounted on its periphery. Each of the rotor blades 18, as can be more easily seen in FIG. 3, is provided with a root 19 by means of which it is attached to the rotor disc 17. The rotor blades 18 are maintained in spaced apart relationship by means of an annular member 20 having slots 21 therein adapted to receive the rotor blades 18. Consequently it will be seen that gaps 22 are defined between adjacent rotor blades 18 which are bounded by the annular member 20, adjacent rotor blades 18 and the periphery of the rotor disc 17.

In order to damp any vibration in the rotor blades 18 which may occur during the operation of the gas turbine engine 10, a damping mixture 23 fills each of the gaps 22. The damping mixture 23 is manufactured by mixing together the following constituents in a "Z" blade mixer.

| | | |
|---|---|---|
| Araldite SV 409 (epoxy resin + thixotropic filler) | 70 | parts by weight |
| Araldite MY 750 epoxy resin | 35.6 | " |
| Araldite 33/1091 hardener | 31 | " |
| Titanium Dioxide | 14 | " |
| Calcined Bauxite | 40 | " |
| Atomized Aluminum Powder | 64 | " |
| Carbon Filaments (0.25 mm long) | 8 | " |

Araldite resins and hardeners are supplied by CIBA-GEIGY (UK) Ltd. Duxford, Cambs.

After mixing, the above constituents are knifed into the gaps 22 before being subjected to the following cure cycle.

16 hours at 100° C.

Increase temperature at 25° C./hour to 200° C.

4 hours at 200° C.

Increase temperature at 25° C./hour to 250° C.

1 hour at 250° C.

It has been found that the thus cured damping mixture 23 provides the following desirable effects at engine compressor operating temperatures (i.e. up to approximately 215° C.)

(a) Effective blade damping.

(b) High compressive strength (i.e. >5000 pounds per square inch). to resist centrifugal force on the mixture during engine running.

(c) Good adhesion to the rotor blades 18.

In addition to the above effects, the damping mixture 23 is resistant to deformation during gelation and curing and is also resistant to slumping in the uncured state. Consequently the damping mixture 23 retains its moulded shape both before and during curing. This is a particularly important property since in certain circumstances, it is not possible to gain access to a rotor disc 17 which has actually been mounted in a gas turbine engine. When this difficulty arises, the rotor blades 18 and annular member 20 are mounted on a dummy rotor disc which has been treated with a silicone release agent. The damping mixture 23 is then knifed into the resultant gaps 22. The dummy disc is then removed and the remaining assembly located on the real rotor disc 17 whereupon the resultant assembly is subjected to the curing cycle outlined above.

Although the present invention has been described with reference to a rotor blade stage located between two stator stages, it will be appreciated that the invention is also applicable to the damping of fan blades. Consequently throughout this specification it is to be understood that the term "rotor blade stage" is intended to include the fan of a turbo fan gas turbine engine.

We claim:

1. A rotor blade stage for the compressor of a gas turbine engine, said rotor blade stage comprising a rotor disc, a plurality of rotor blades and an infilling mixture, said rotor blades being equally spaced apart and mounted on the periphery of said rotor disc, each of said blades having opposing sides which diverge radially outwardly, the spaces between the facing sides of adjacent ones of said rotor blades in the region of the periphery of said rotor disc being infilled with said infilling mixture, said infilling mixture comprising reinforcing filaments enclosed in a matrix comprising a cured epoxy resin and a filler material, means radially outwardly of said mixture for retaining it in position between said rotor blades upon the rotation of said disc, said retaining means having sides which conform to and abut the facing sides of adjacent rotor blades and extending between the facing sides of adjacent rotor blades.

2. A rotor blade stage as claimed in claim 1 wherein said filaments are of carbon.

3. A rotor blade stage as claimed in claim 2 wherein said carbon filaments are not longer than 0.25 mm.

4. A rotor blade stage as claimed in claim 1 wherein said filling material comprises a thixotropic filler, titanium dioxide, calcined bauxite and atomized aluminium powder.

5. A rotor blade stage as claimed in claim 1 wherein said retaining means comprises an annular member having slots adapted to receive said rotor blades and which is spaced apart from said rotor disc so as to define cavities with said rotor disc periphery and said rotor blades within which said infilling mixture is located.

6. A rotor blade for the compressor of a gas turbine engine, said rotor blade stage comprising:

a rotor disc;

a plurality of substantially equally circumferentially spaced apart rotor blades mounted on the periphery of said rotor disc, each of said blades having sides which diverge radially outwardly;

an infilling mixture infilled in the spaces immediately radially outwardly of the rotor disc and between the facing sides of each adjacent pair of said rotor blades, said infilling mixture comprising carbon reinforcing filaments not longer than 0.25 mm enclosed in a matrix comprising a cured epoxy resin and a filler material; and an annular member coaxial with and radially outwardly spaced from the periphery of the rotor disc to define annular cavities with the rotor disc periphery in which is filled the infilling mixture for holding the infilling mixture in position between the rotor blades, said member having a plurality of substantially equally circumferentially spaced apart slots therein through each of which a respective one of said blades extends, each of said slots having facing sides which conform to and abut the corresponding sides of the blade extending therethrough.

* * * * *